US011391494B2

(12) United States Patent
Smith et al.

(10) Patent No.: US 11,391,494 B2
(45) Date of Patent: Jul. 19, 2022

(54) MULTIPLE DIRECTIONAL BLOW UNIT COOLER

(71) Applicants: Donald Eugene Smith, Fullerton, CA (US); Christine Marie Smith, Fullerton, CA (US)

(72) Inventors: Donald Eugene Smith, Fullerton, CA (US); Christine Marie Smith, Fullerton, CA (US)

( * ) Notice: Subject to any disclaimer, the term of this patent is extended or adjusted under 35 U.S.C. 154(b) by 0 days.

(21) Appl. No.: 16/989,579

(22) Filed: Aug. 10, 2020

(65) Prior Publication Data

US 2020/0370791 A1 Nov. 26, 2020

(51) Int. Cl.

| | |
|---|---|
| ***F25B 3/00*** | (2006.01) |
| ***F25B 1/00*** | (2006.01) |
| ***F25B 39/02*** | (2006.01) |
| *F25D 17/06* | (2006.01) |

(52) U.S. Cl.

CPC ..... *F25B 3/00* (2013.01); *F25B 1/005* (2013.01); *F25B 39/02* (2013.01); *F25D 17/067* (2013.01)

(58) Field of Classification Search

CPC .. F25B 3/00; F25B 1/005; F25B 39/02; F25D 17/067; F28F 9/001; F24F 2013/205; F24F 2221/17; F24F 1/0057; F24F 1/0033; F24F 2221/14; F24F 13/082; F24F 2013/227

See application file for complete search history.

(56) References Cited

U.S. PATENT DOCUMENTS

| | | | | |
|---|---|---|---|---|
| 5,248,121 | A * | 9/1993 | Harrington | A47G 1/168 248/477 |
| 7,448,224 | B2 * | 11/2008 | Wu | F24F 13/20 62/77 |
| 2008/0302120 | A1 * | 12/2008 | Kang | F04D 25/064 62/259.1 |
| 2011/0247352 | A1 * | 10/2011 | Zanolin | F24F 13/32 62/263 |
| 2013/0068421 | A1 * | 3/2013 | Army | F28F 11/00 165/70 |
| 2018/0202685 | A1 * | 7/2018 | Pignolo | F24F 13/222 |

FOREIGN PATENT DOCUMENTS

| | | | | |
|---|---|---|---|---|
| WO | WO-02055937 | A1 * | 7/2002 | F25B 13/00 |
| WO | WO-02061345 | A1 * | 8/2002 | F24F 1/005 |

OTHER PUBLICATIONS

English Translation WO 2002/055937 (Year: 2002).*
English Translation W02002/061345 (Year: 2002).*

* cited by examiner

*Primary Examiner* — David J Teitelbaum
(74) *Attorney, Agent, or Firm* — Steven A. Nielsen; www.NielsenPatents.com

(57) ABSTRACT

An evaporator coil and housing system is sometimes used in commercial applications wherein refrigeration occurs in confined and harsh environments. The disclosed evaporator coils are energy efficient, configured for installation in areas typically not suited for evaporator coil insulation, and made to withstand acids and other contaminants of spilled food stuffs. The fan motors are also made to withstand contaminates often found in commercial food environments. The various housing assemblies allow for air flow in a plethora of directions to comport with the most constrained and difficult applications. Multiple blow directions may be configured and individual blow patterns may be configured in a cone shape for maximum efficiency.

12 Claims, 15 Drawing Sheets

MULTIPLE DIRECTIONAL BLOW UNIT COOLER

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates refrigeration systems. More particularly, the invention relates to the manufacture and application of evaporator coil systems contained within housing assemblies that comport to compact, awkward and food contaminated commercial environments.

(2) Description of the Related Art

U.S. Pat. No. 9,242,525 by Kobayshi and issued on Jan. 26, 2016 teaches multi directional blowing in a rotational assembly wherein a condenser coil and evaporator coil rotate around an elongated shaft. While Kobayshi does provide directed outlets, Kobayshi fail to teach or anticipate the multiple directions of air flow enabled by the presently disclosed embodiments. Moreover, Kobayshi adds complexity and mechanical challenge in refrigeration since Kobayshi requires the use of balancing weights, a feature not needed in the disclosed embodiments.

U.S. Patent Publication 2014/0360221 by Kyle et al and published on Dec. 11, 2014 discloses a refrigeration system suited for small boats. Kyle uses a self-contained system taking the shape of a hollow cylinder. While Kyle appears to be well suited for compact spaces, Kyle fails to teach, suggest or disclose means or methods of accommodating varying directions of air flow as needed in land based commercial settings.

U.S. Pat. No. 8,117,864 by Montminy et al and granted on Feb. 21, 2012 discloses modular and compact air conditioning systems used in small carts for air craft support. While the Montminy system is compact, the system does not contemplate, anticipate or suggest the use of a housing system to allow for quick adjustment of air flow direction or multiple mounting positions.

BRIEF SUMMARY OF THE INVENTION

The present invention overcomes shortfalls in the related art by presenting an unobvious and unique combination, configuration and use of mounting brackets, housing configurations, fan motors, shaped discharge of blown air, and other features to create a versatile system that is well suited for a myriad of commercial environments.

The known related art fails to disclose, suggest or teach the use of the disclosed coil and fan mounting systems wherein two or so mounting brackets can be used interchangeably within the system to allow for multiple mounting positions, such as back wall mount, ceiling mount or a mullion style mount. The disclosed embodiments achieve advantages in manufacture by use of a frame or housing system that easily and nondestructively comports to many mounting positions and airflow configurations.

Objectives of the disclosed embodiments include the efficient manufacture of a line of evaporator coils that are energy efficient, quickly adaptable to fit into tight areas, extremely versatile, strong and compatible to the harsh environments evaporator coils are subject to in commercial environments, especially those in the food industry.

The disclosed embodiments may include multiple coils with varying BTU ratings. Various embodiments may be of the same height and depth and may use the same motors and other components.

A main assembly, housing or body may comprise a front cover, back panel, drain pans mounts and other components that may be comprised of 20-gauge 304 stainless steel or similar materials. Such materials and/or other disclosed features, give the disclosed embodiments the needed durability and longevity to survive in commercial food environments. The disclosed evaporator coils and other disclosed components are well suited for harsh environments wherein food and sauces may disburse acids and other contaminants that will corrode the systems of the related art. Said coils may be coated by dipping and baking so as to add longevity to the coils.

Disclosed embodiments include unique fan motors, motor bodies and impellers may be made of plastic or other non-corrosive materials so as not to rust or corrode. Disclosed motors may include ball bearing that comprise protective coatings to minimize water damage to the bearings. The disclosed motors may be RoHS II certified and/or are rated to operate at 100 v-240 v 50/60 hz. Disclosed motors may use or require 0.06 amps or less, which represents a meaningful improvement as compared to the related art. The blow pattern of a disclosed motor may comport to a cone shape. In a disclosed cone shaped discharge, the flow starts at the base of the motor and projects air outwardly in a cone shape. Disclosed cone shape discharges cover more area than a direct air pattern, as embraced by the prior art.

The disclosed embodiments include versatility in mounting and use of variable and multiple air blow directions. Disclosed coils can be efficiently mounted to a back-wall mount, ceiling mount, mullion style mount. The different mounting positions may be achieved with just two interchangeable mounting brackets. With said mounting brackets sometimes made from 304 stainless steel. The depth of the coils may be 4⅜" deep, allowing a disclosed coil to fit in areas where coils of the prior art would not fit. To make multiple mounting options feasible and to overcome air flow problems of the related art, disclosed embodiments allow for quick attachment or configuration of multiple fans to enable multiple air flow directions and multiple points of origin and destination of air flow. Embodiments may be quickly and nondestructively configured to blow air forward, up, and back. Moreover, multiple directions of air flow may be combined and may occur at the same time. The prior art fails to provide such quickly executed versatility. The prior art requires multiple fixed configurations that are selected or purchased separately for each anticipated mounting and blow pattern environment. Thus, the prior art has a significant shortfall in requiring vendors to purchase, store and stock multiple models, or special order a particular model.

REFERENCE NUMERALS IN THE DRAWINGS

Figure 1:
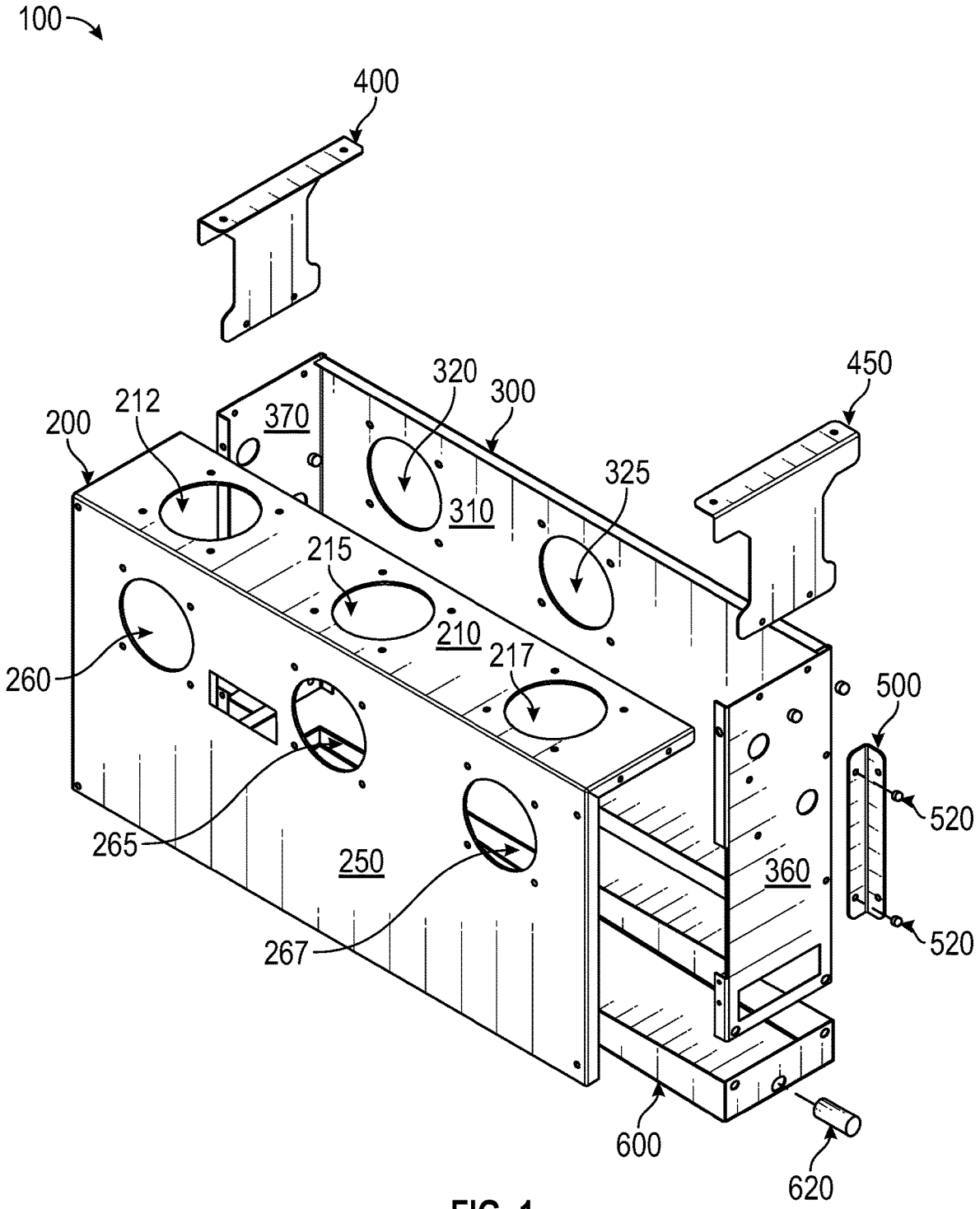
FIG. 1 exploded view of housing assembly
FIG. 2 perspective view of a wall mount configuration
FIG. 3 perspective view of a mullion mount configuration FIG. 4 top view in a wall mount configuration
FIG. 5 front view in a wall mount configuration
FIG. 6 end view in a wall mount configuration
FIG. 7 rear view in a mullion mount configuration
FIG. 8 perspective vie of front plate
FIG. 9 side edge assembly of front plate from FIG. 8
FIG. 10 expanded view of fastener detail from FIG. 9
FIG. 11 perspective view of a mullion mount bracket
FIG. 12 perspective view with front plate removed
FIG. 13 back plate with coil installed
FIG. 14 various internal components
FIG. 15 back plate and front plate of a horizontal embodiment
FIG. 16 front view with front fans installed and top fan voids covered
FIG. 17 perspective view of a cooling side of a horizontal embodiment
FIG. 18 perspective view of a drainage end of a horizontal embodiment
FIG. 19 inner side of a front plate for a horizontal embodiment
FIG. 20 outer side of a front plate for a horizontal embodiment

100 housing assembly
200 front plate of housing assembly
203 front plate of a horizontal embodiment
204 drainage wall of front plate 203 for horizontal embodiment
205 drainage creases for front plate of a horizontal embodiment
207 a horizontal embodiment in general
210 top ledge of front plate 200
212 first top void defined within top ledge 210
215 second top void defined within top ledge 210
217 third top void defined within top ledge 210
250 side wall of front plate 200
260 first side void defined within side wall 250
265 second side void defined within side wall 250
267 third side void defined within side wall 250
280 lateral edge piece
285 tig weld at transition junctions of lateral edge pieces
290 instrument reading void defined within the side wall or front wall of the front plate
293 lower edge or lower edges of front plate
300 back plate of housing assembly
310 vertical wall of backplate
320 first void defined within vertical wall of backplate
325 second void defined within vertical wall of backplate
360 left side wall of back plate
370 right side wall of back plate
380 lower edge or lower edges of back plate
400 first mullion mount bracket
410 top horizontal plate of mullion mount bracket 400
421 vertical extension section of mullion mount bracket
425 transition jog between vertical extension section 421 and lower mount plate 430
430 lower mount plate of mullion mount bracket 400
450 second mullion mount bracket
470 housing in a mullion mount configuration
500 back support angle
520 fastener such as a button rivet
550 housing in a wall mount configuration 720
600 drip pan
620 drain tube of drip pan
630 air circulation void defined by upper edges of drain pan and lower edges of front plate and back plate
635 upper edge or upper edges of drip pan 600
700 fan
720 protective cage for fan
730 void cover, in area sometimes used for a fan 300
800 evaporation coil These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a housing assembly 100 may include a front plate 200, a back plate 300, a drip pan 600. At least two mounting options are easily configured without breaching the inside of the housing. For a back mount application, a first and second back support angle 500 may be attached to the back plate. The back support angle may then be attached to a wall or other environmental element. An advantage of the disclosed embodiments is that a unit may be sold with both a set of mullion mount brackets 400 and back support angles 500 at little additional cost. Such a configuration allows an end user or installer to make an onsite decision as to a mounting position without having to open the housing.

Figure 13:
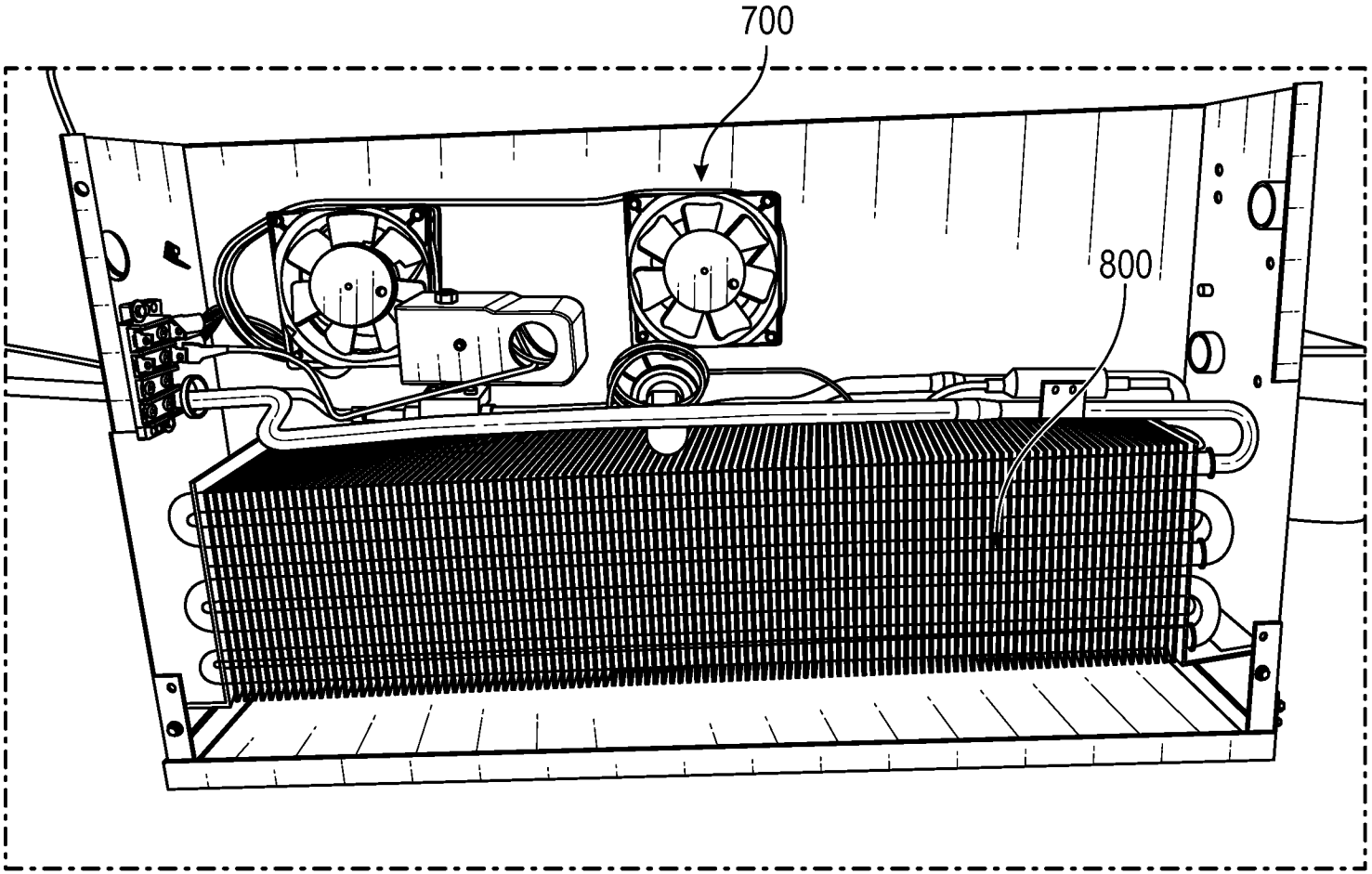
Figure 15:
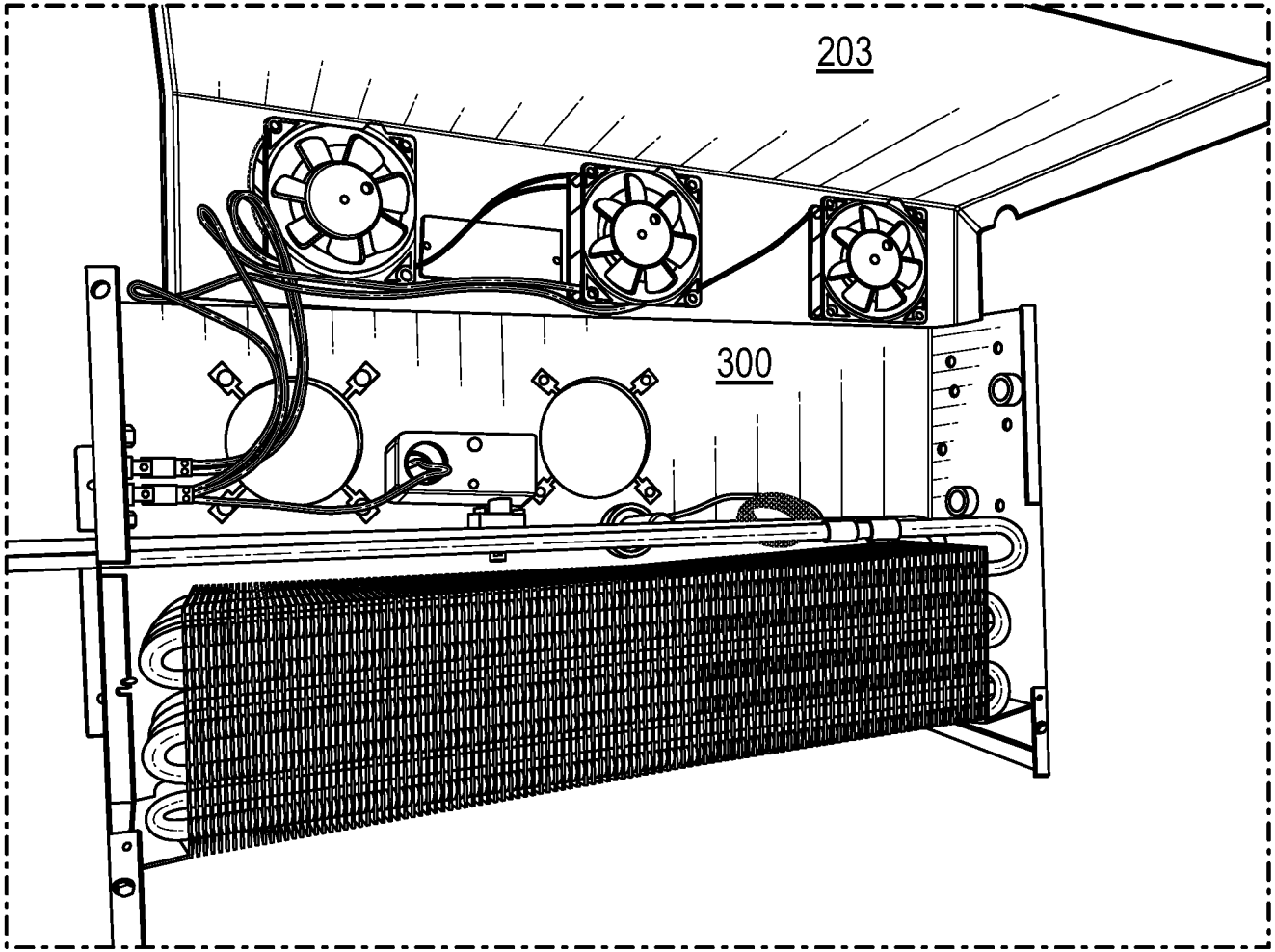

A further advantage over the prior art is that the disclosed embodiments may include a plurality of fan voids with the fan voids being defined within three different surfaces with each surface disposed on a different plane. Each fan void may be filled with a fan or a void cover. Each fan void may be filled or equipped with a fan with such installation not requiring a movement or reinstallation of a coil. A coil, as shown in FIG. 13, a coil is disposed within a lower section of a back plate, allowing the fan voids of the back plate to be covered or filled with fans without disturbing the installed coil. Since there are few or no parts installed upon the front plate, the voids of the front plate are easily covered or filled with fans. Due in part, to the combination of housing assembly elements, the front and back plates may be removed or attached to one another with ease, as shown in FIG. 15.

Figure 9:
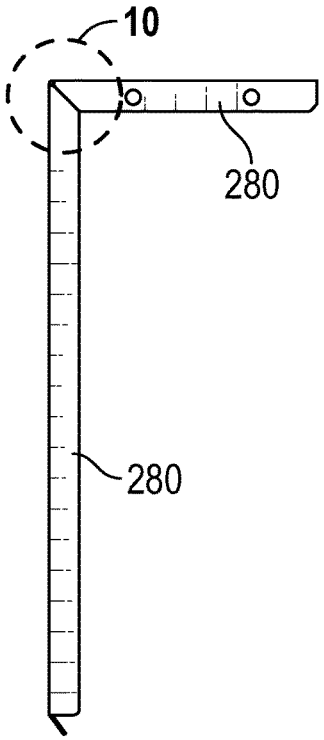

Referring to FIG. 1, a front plate 200 may comprise a top ledge 210 with the top ledge defining a first top void 212, a second top void 215 and a third top void 217. A front plate may also comprise a side wall 250 or front wall, with the side wall sometimes defining a first side void 250, a second side void 265 and a third side void 267. The sides or lateral edges of the front plate may comprise a bent lip or lateral edge pieces, as shown in FIG. 9 in reference number 280.

A backplate 300 may comprise two side walls such as a left side wall 360 and a right sidewall 370 with the terms "left" and "right" being interchangeable. A backplate may further comprise a vertical wall or back wall which may define a first void 320 and a second void 325. An advantage of the disclosed configurations is that both the back support angles 500 and mullion mount brackets 400 may be attached to the back plate only, allowing the front plate to be removed for unit servicing without having to dismount the unit from the wall or ceiling.

Figure 2:
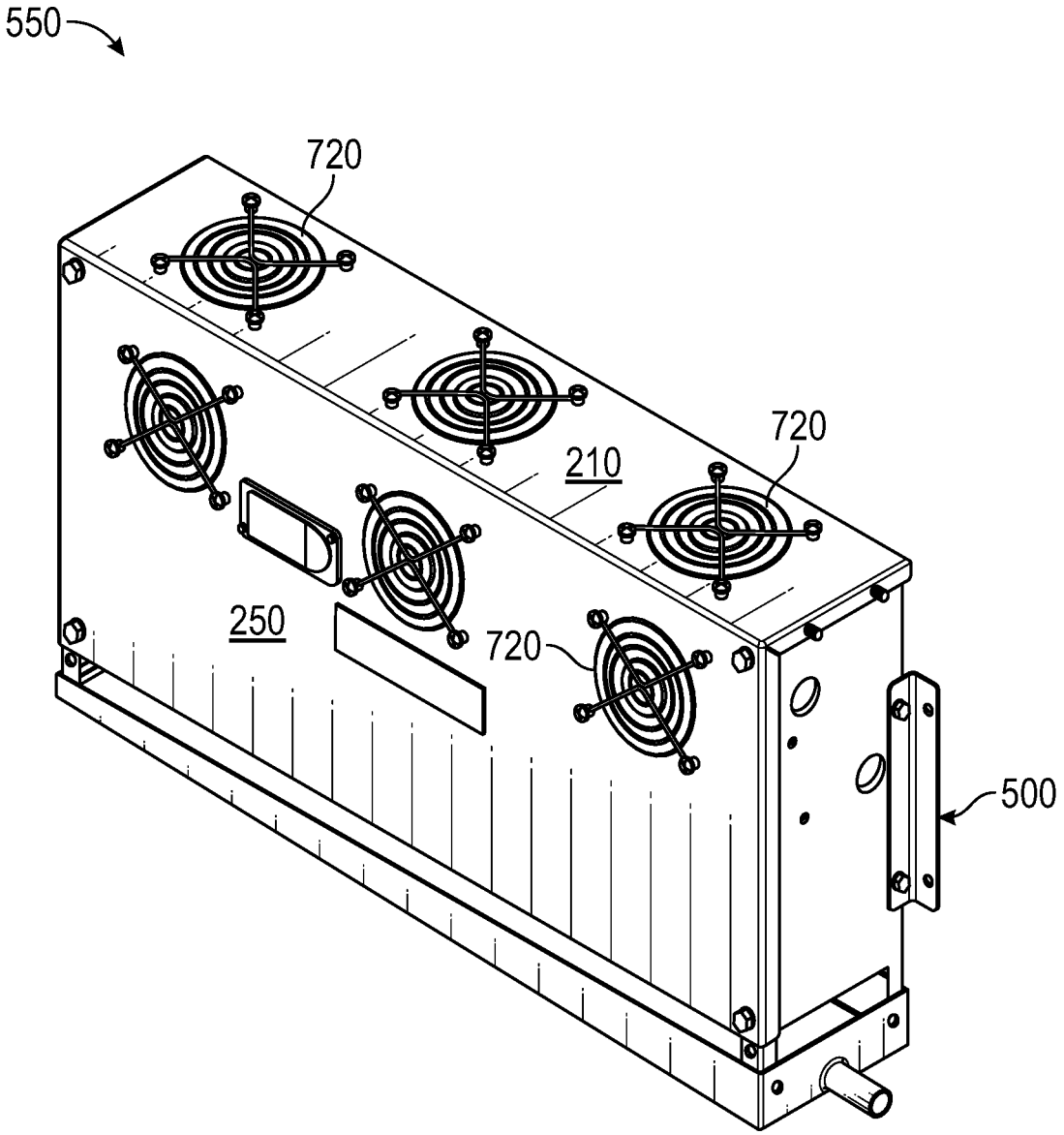

Referring to FIG. 2, a perspective view of an assembled embodiment is illustrated with fans disposed in three voids of the side wall 250 or front wall of the front plate and three voids of the top ledge of the front plate are used to secure fans as well. In this illustrated configuration, air is blown in both front and upward directions.

Disclosed embodiments overcome shortfalls in the related art by use of air circulation voids 630 which may be defined by upper edges 635 of the drain pan and front plate lower edges 293 and back plate lower edges 380. The circulation void or circulation voids are artfully created by using the native edges of the back plate, front plate and drain pan so as to not require any modifications to the housing components. Superior intake air flow is achieved by the circulation void(s) in that the circulation voids are distal from the fan voids and fans so as to draw air over the internal coil.

Figure 3:
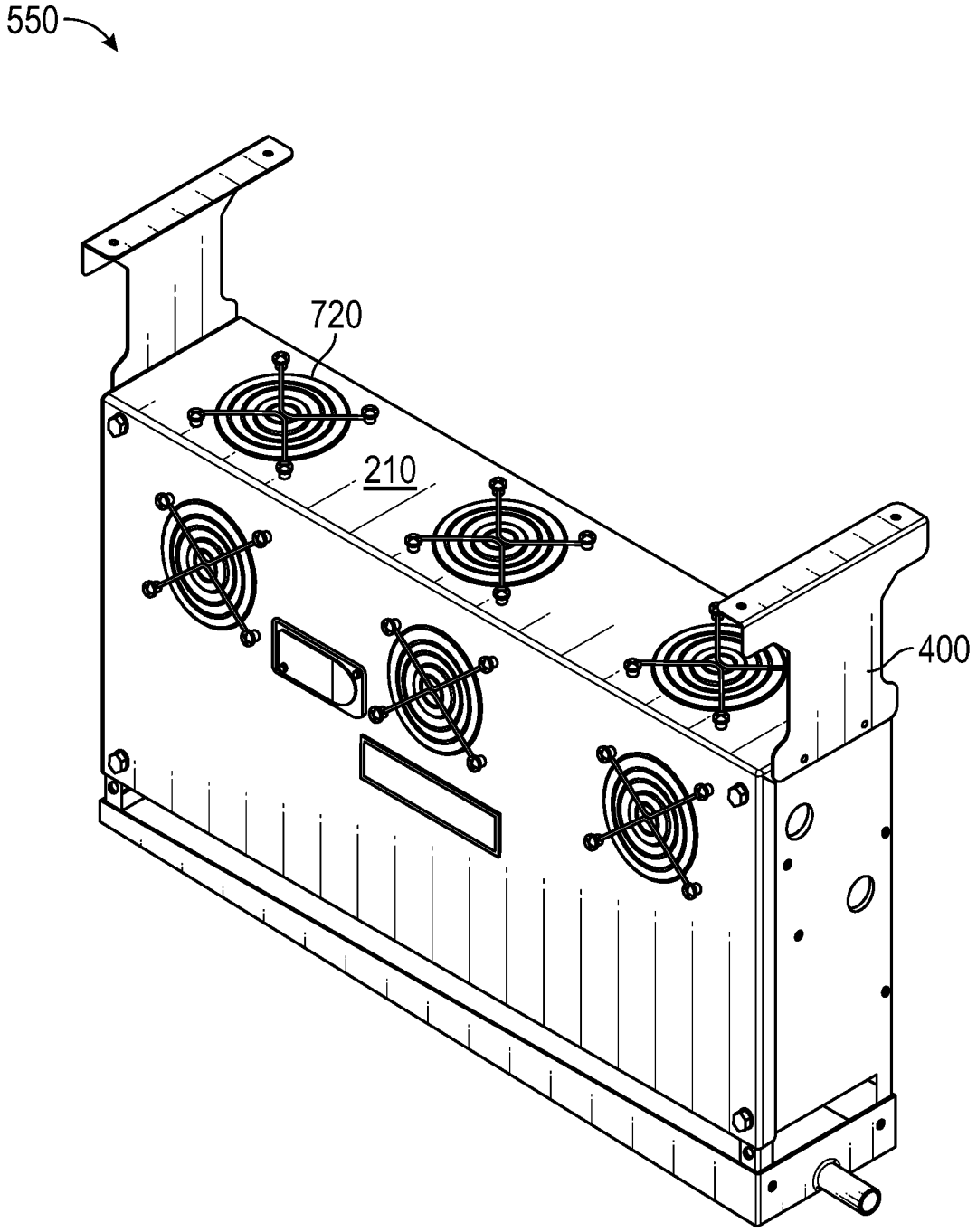

FIG. 3 is similar to FIG. 2, except a wall mount configuration 550 is shown wherein a pair of mullion mount brackets are disposed on the superior section of the embodiment, allowing for ceiling installation.

Figure 4:
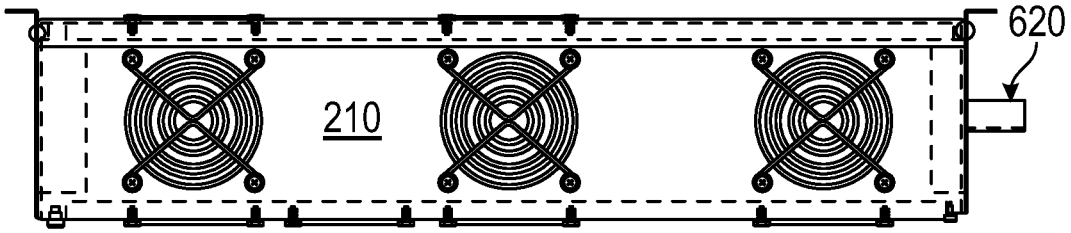

FIG. 4 depicts a top view of a top ledge 210 of a front plate or a top end component. The fans are shown to be installed for the upward movement of air.

Figure 5:
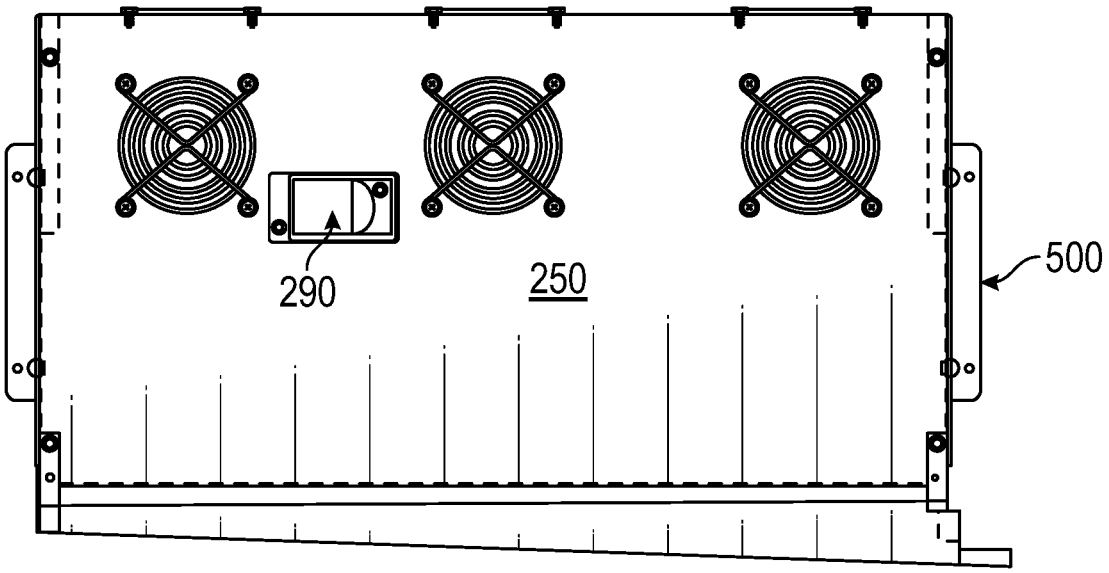

FIG. 5 depicts a front view of a disclosed embodiment with three fans installed for a front movement of air.

Figure 6:
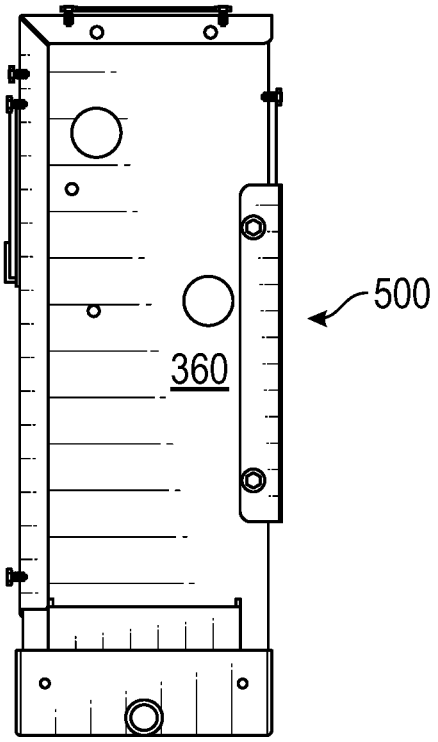

FIG. 6 depicts a side of a disclosed embodiment, or a view of a left side wall 360 of a backplate. A back support angle 500 is attached to the back plate.

Figure 7:
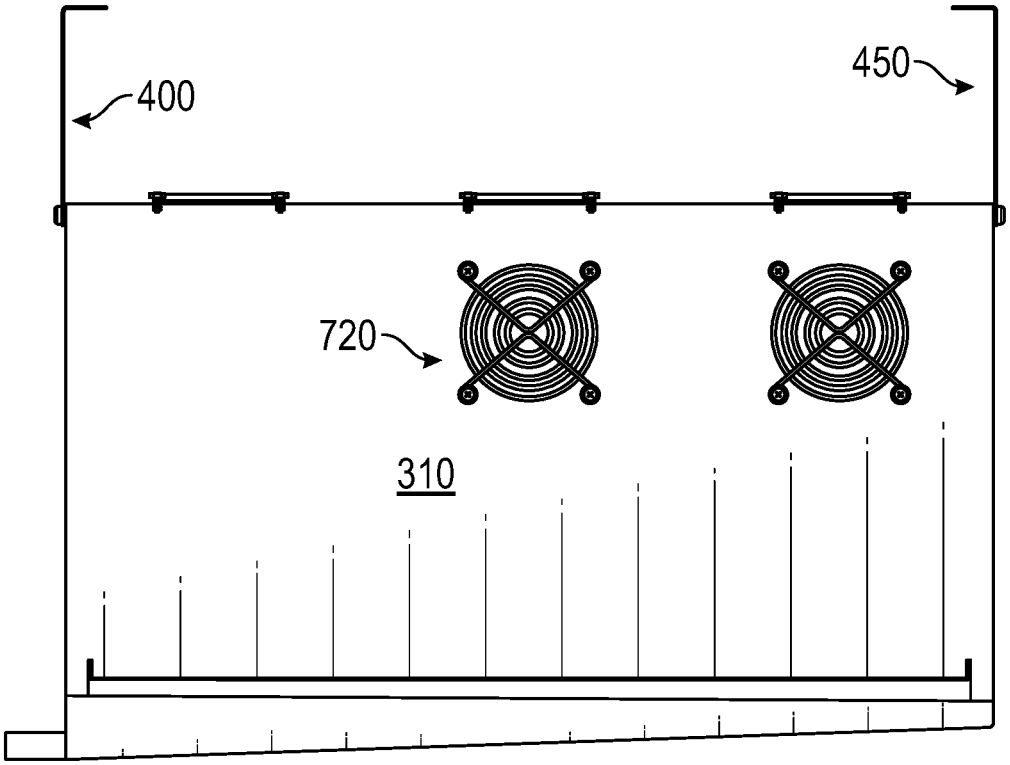

FIG. 7 depicts a back side of a disclosed embodiment with a fan disposed within or upon each of the voids defined with in the vertical wall 310 or back wall of the backplate. Such a fan configuration will result in a rearward flow of air.

Figure 8:
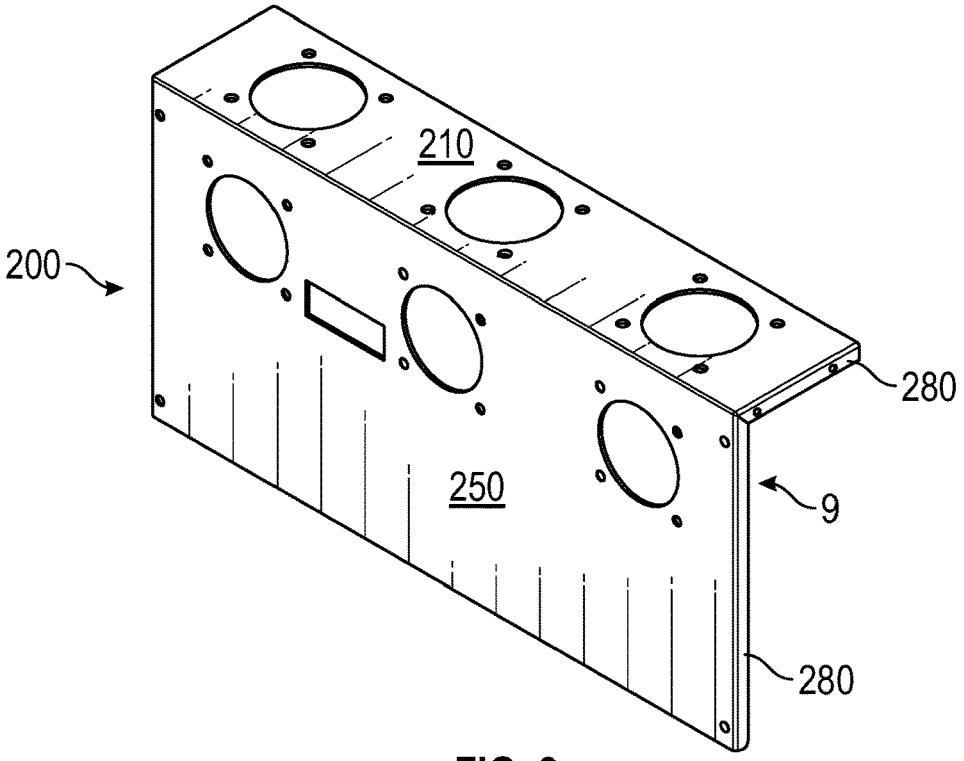

FIG. 8 depicts a front plate 200 or front cover comprising a lateral edge piece 280 or edge surface disposed at either lateral side of the front plate.

FIG. 9 more clearly shows lateral edge piece components 280.

Figure 10:
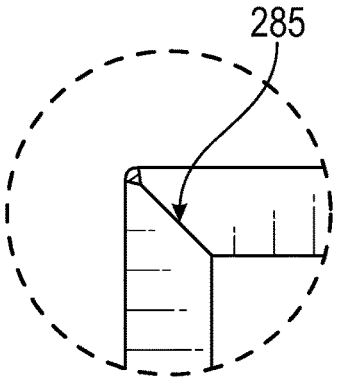

FIG. 10 depicts a joint or transition area of FIG. 9 and shows a tig weld 285 at said transition point.

Figure 11:
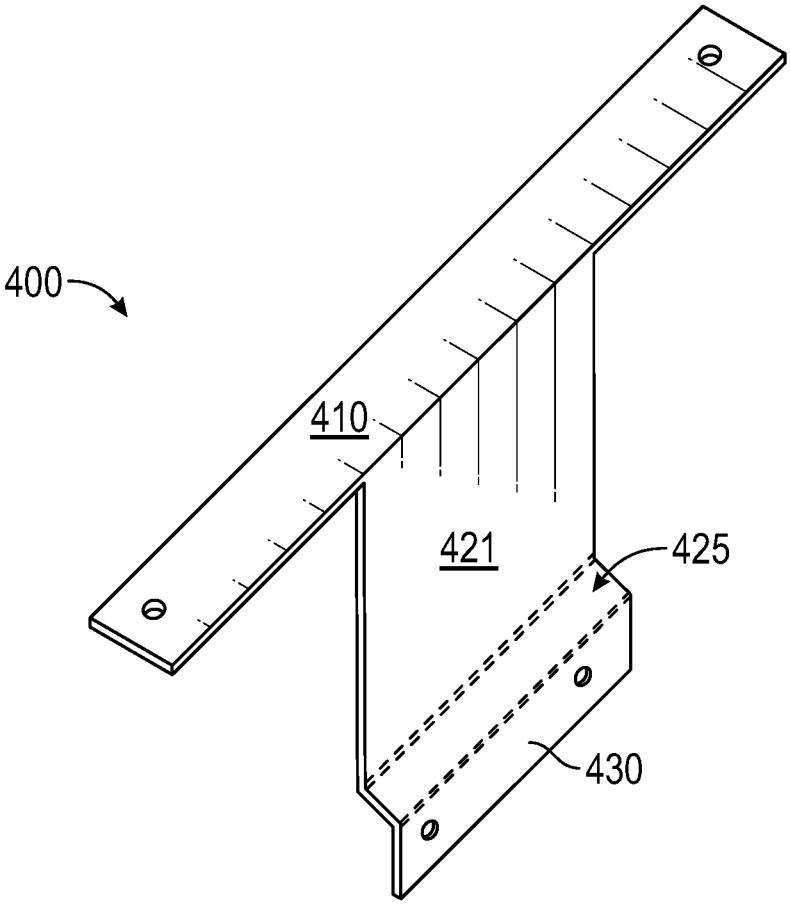

FIG. 11 depicts a perspective view of a mullion mount bracket 400 that may comprise a lower mount plate 430 attached at an inward angle to a transition jog 425 with the transition jog attached to a vertical extension section 421 with the vertical extension section attached to top horizontal plate 410. Said features of the mullion mount bracket overcome shortfalls in the related art by increasing ease of installation as the top horizontal plates 410 are disposed inwardly from the lateral sides of the backplate, allowing working room for insertion of fasteners through voids of the top horizontal plates. Thus, an embedment may be installed tightly at an interior corner and an installer will have room to access the top horizontal plate by virtue of the inward distance gained by use of the transition jog 425.

Figure 12:
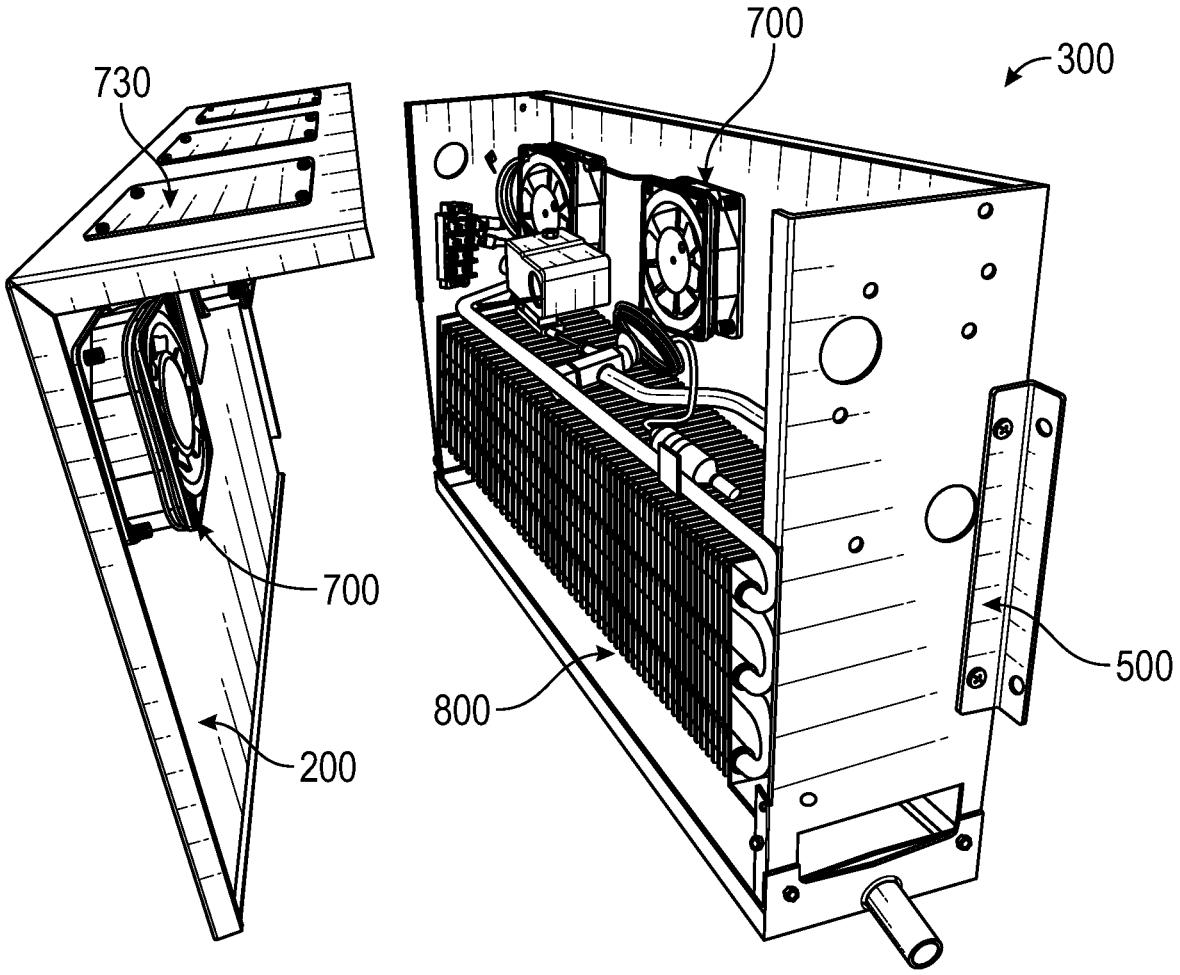

FIG. 12 depicts a front plate 200 being attached to a backplate 300 with fans 700 disposed within voids of the front plate and back plate. A coil 800 is disposed within the lower confines of the backplate so as to not interfere with the installation of either fans or void covers upon voids of the backplate. In this configuration, air will blow from both the front and back sides of the embodiment.

FIG. 13 depicts and evaporator coil disposed within a backplate.

Figure 14:
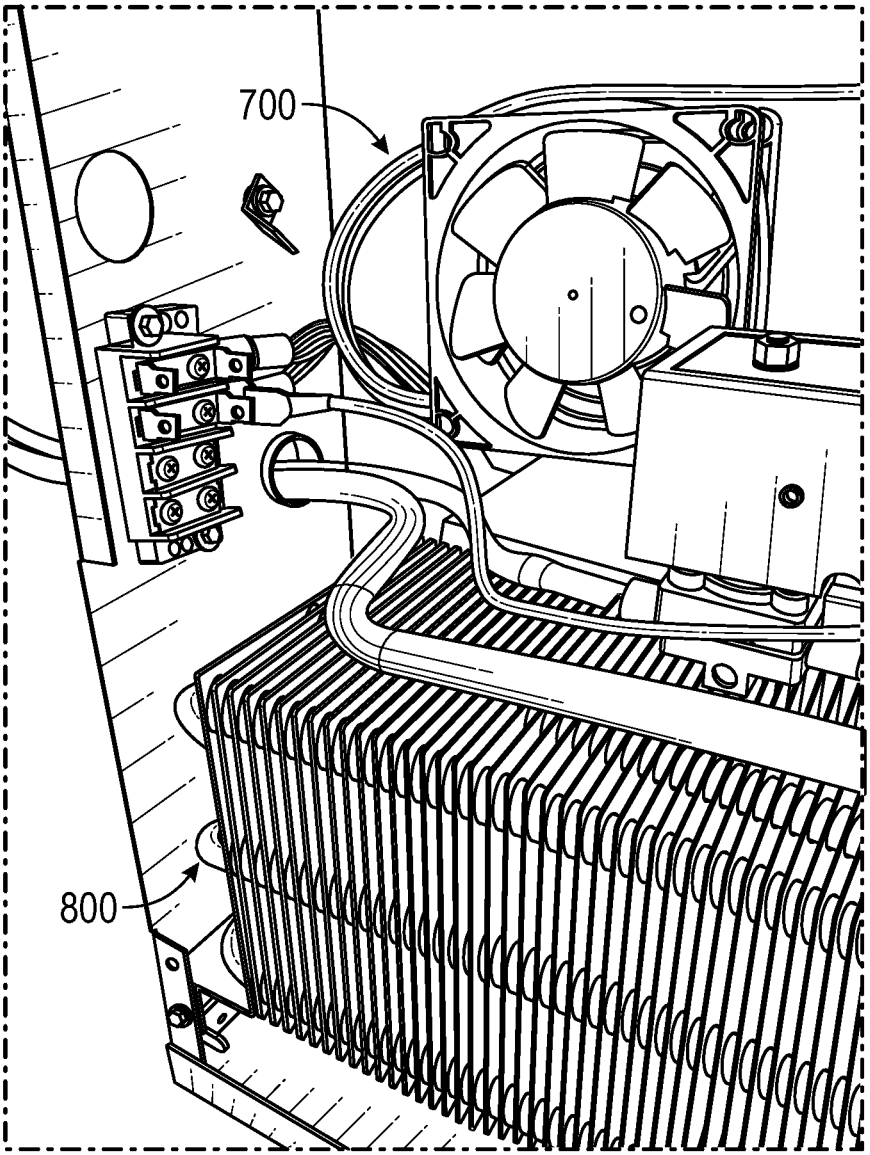

FIG. 14 depicts further components disposed within a backplate.

FIG. 15 depicts a front plate 203 of a horizontal embodiment in wired connection with a backplate 300.

Figure 16:
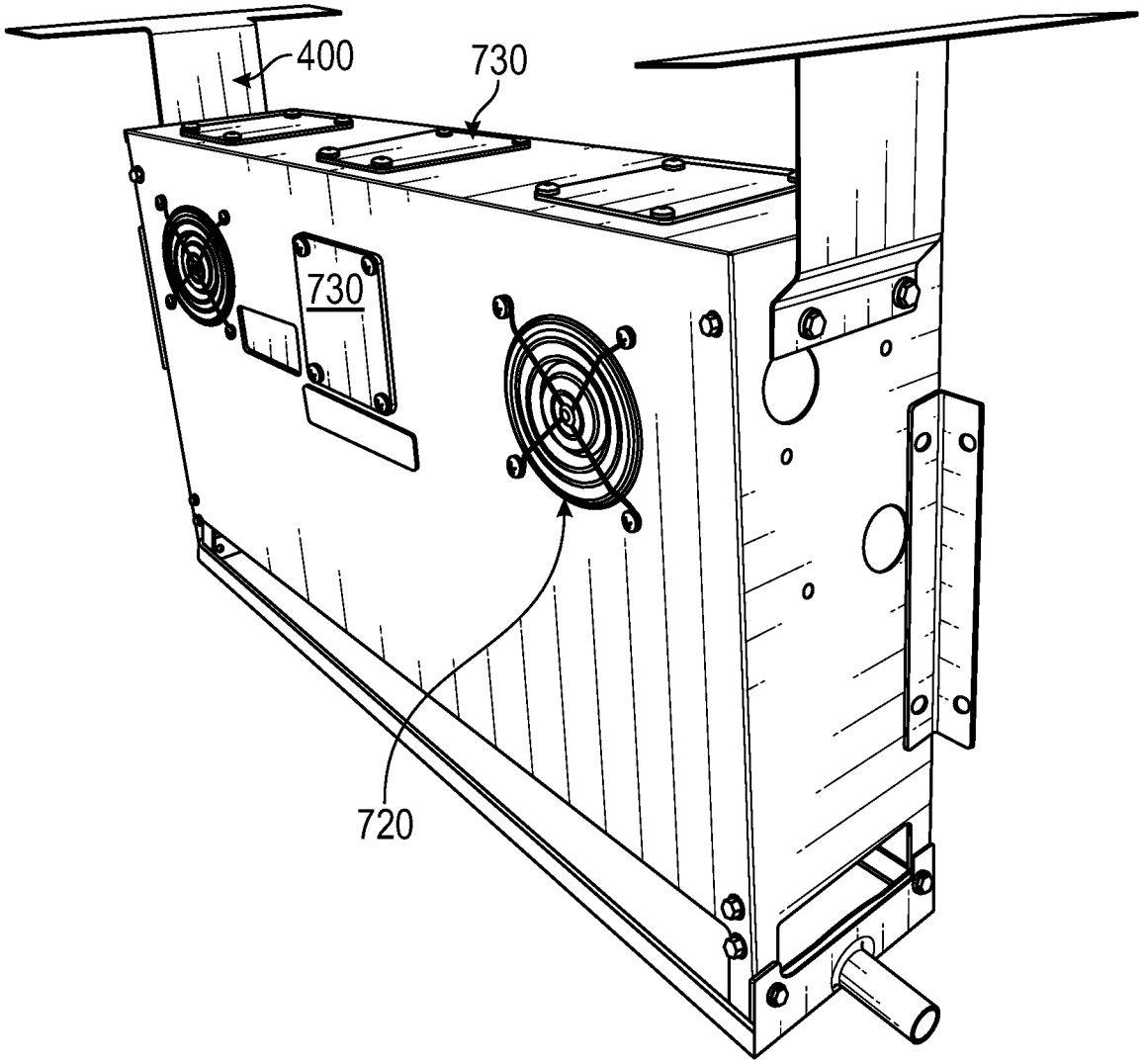

FIG. 16 depicts an embodiment ready for either mullion mounting or vertical surface mounting. Void covers 730 block fan voids in both the backplate and front plate.

Figure 17:
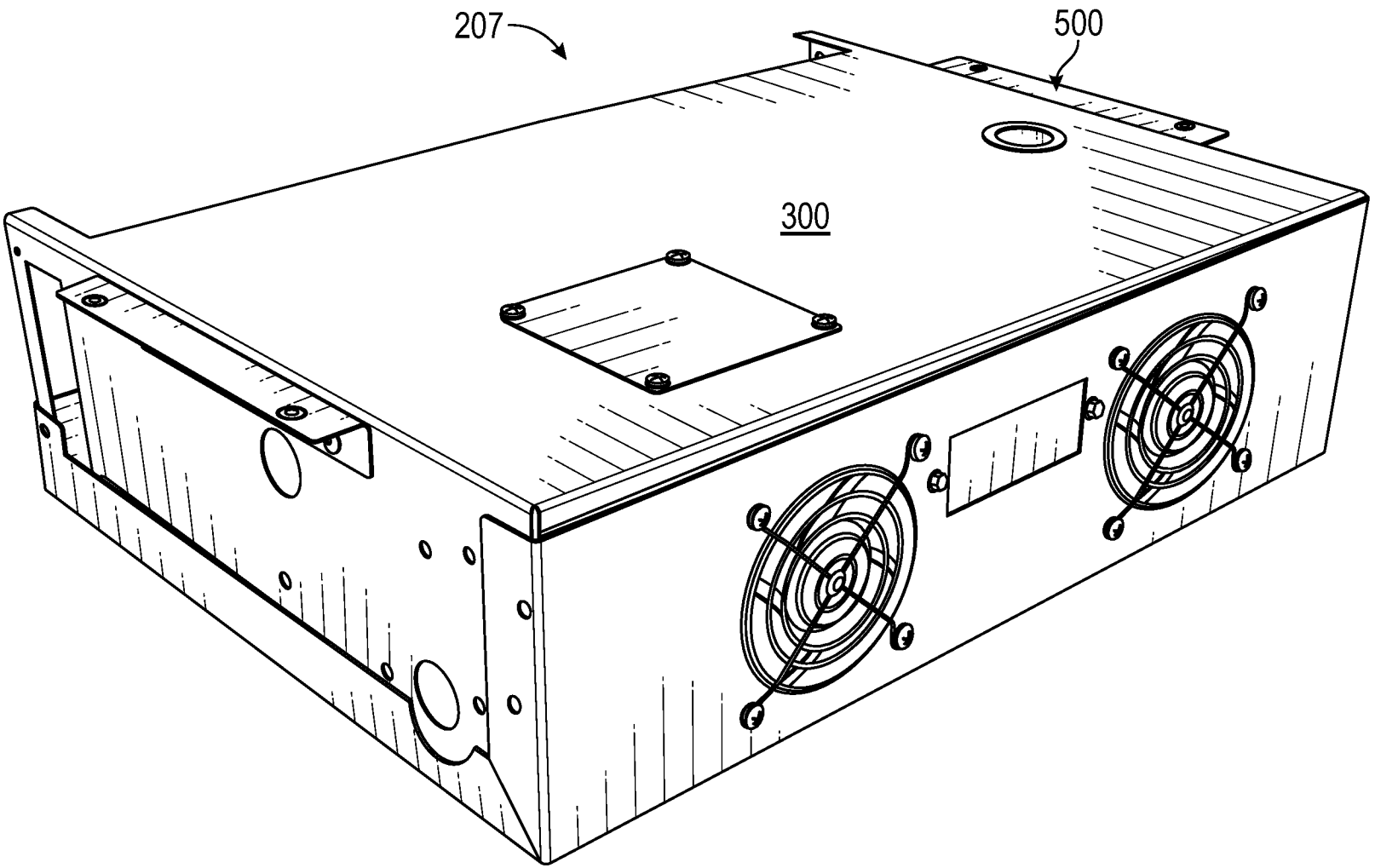

FIG. 17 depicts a horizontal embodiment 207 and the use of back support angles 500.

Figure 18:
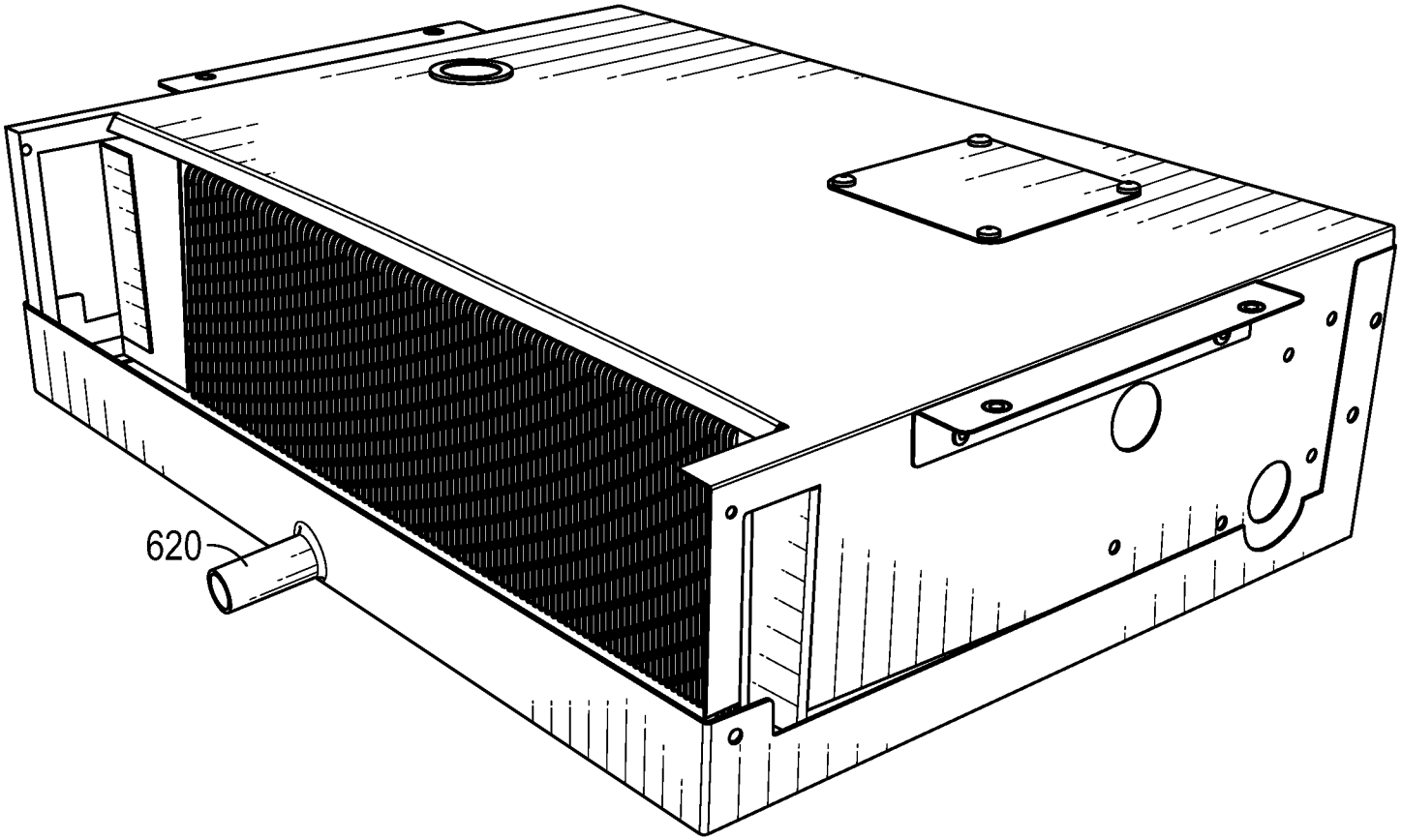

FIG. 18 depicts a horizontal embodiment with a horizontally disposed drain tube 620.

Figure 19:
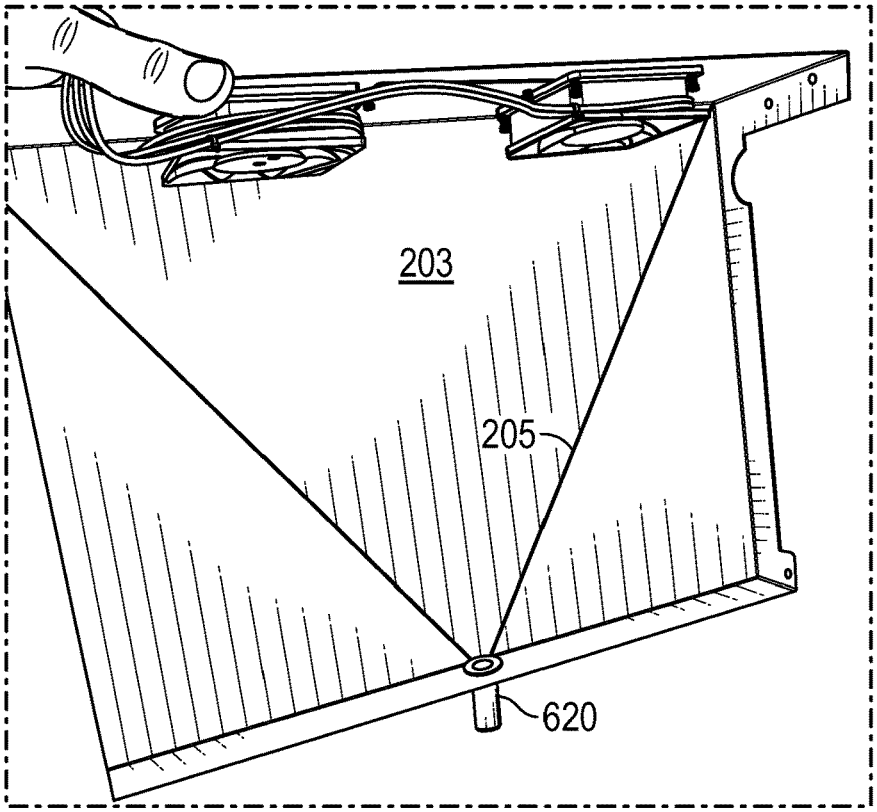

FIG. 19 depicts inside components or features of a front plate 203 for a horizontal embodiment, with the front plate 203 comprising drainage creases 205 or drainage valleys that provide guidance and slope for fluid drainage to the drain tube 620.

Figure 20:
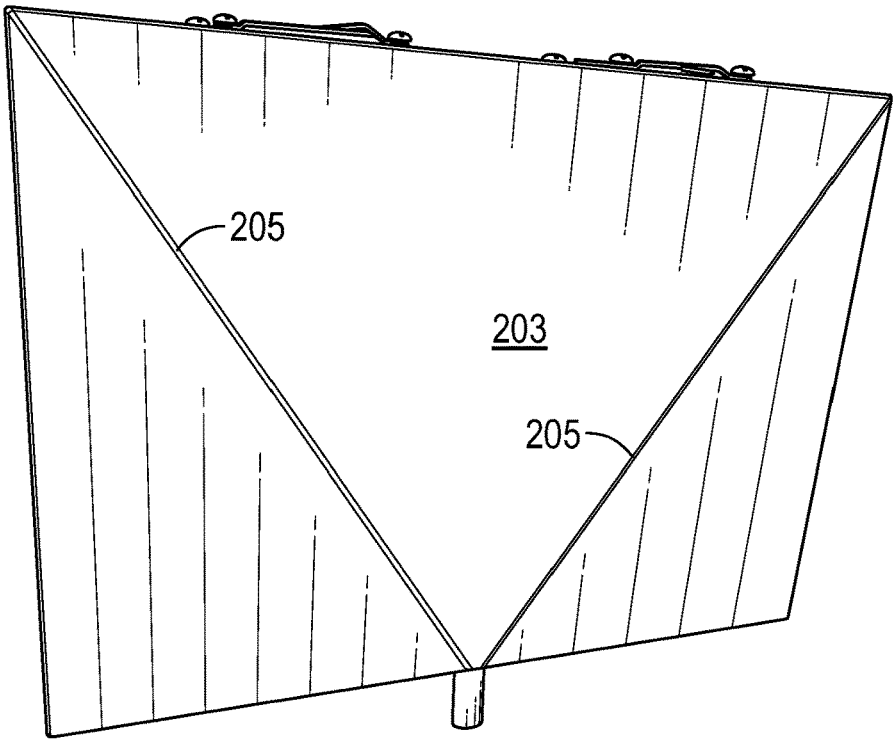

FIG. 20 depicts an outside surface of front plate 203.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A multiple directional blow unit cooler comprising:

a) a front plate;

b) the front plate comprising a side wall with the side wall defining a plurality of voids;

c) the front plate further comprising a top ledge attached to and normal to the sidewall, with the top ledge defining a plurality of voids;

d) the front plate further comprising two sides, with each side comprising a lateral edge piece with each lateral edge piece comprising a transition junction;

e) a backplate comprising a vertical wall with the vertical wall comprising a plurality of voids, the backplate further comprising a left side wall, a right side wall;

f) a drip pan;

g) a first and a second support structures attached to the back plate for further attachment with the wall or the ceiling, thereby allowing the front plate to be removed without having to dismount the multiple directional blow unit cooler from the wall or the ceiling, the first and the second support structures being any one of first and second back support angles and first and second mullion mount brackets; and h) an evaporation coil arranged laterally within a lower section of the back plate with air being drawn from a bottom of the evaporation coil, thereby allowing the voids of the back plate to be covered or filled with fans without disturbing the evaporation coil;

wherein the front plate is fastened to the back plate and the drip pan is attached below the front plate and back plate in a manner that defines a circulation void for drawing air over the evaporation coil, the circulation void being defined by top edges of the pan and lower edges of the front plate and lower edges of the back plate.

2. The multiple directional blow unit cooler of claim 1, wherein the first and second mullion mount brackets each comprise a top horizontal plate attached to a vertical extension section with the vertical extension section attached to a transition jog and the transition jog attached to a lower mount plate.

3. The multiple directional blow unit cooler of claim 1, further comprising one or more fans disposed within the voids of the front plate.

4. The multiple directional blow unit cooler of claim 1, further comprising one or more fans disposed within the voids of the back plate.

5. The multiple directional blow unit cooler of claim 1, further comprising one or more void covers disposed over voids of the front plate.

6. The multiple directional blow unit cooler of claim 1, further comprising one or more void covers disposed over voids of the back plate.

7. The multiple directional blow unit cooler of claim 1, further comprising a motor configured to generate a blow pattern of air in a cone shape in which the flow of air starts at a base of the motor and projects air outwardly in the cone shape, thereby covering an area by the blown air.

8. The multiple directional blow unit cooler of claim 1, wherein the first and second support structures are attached to the back plate only, thereby allowing the front plate to be removed for unit servicing without having to dismount the unit.

9. The multiple directional blow unit cooler of claim 1, wherein the circulation void is distal from the plurality of voids of the front plate and the plurality of voids of the back plate.

10. A multiple directional blow unit cooler for horizontal placement comprising:

a) a front plate;

b) the front plate comprising a drainage wall, the drainage wall comprising a plurality of drainage creases, the drainage creases converging upon a drain tube, the drain tube disposed upon the front plate;

c) the front plate further comprising a top ledge, the top ledge attached to the drainage wall, with the top ledge defining a plurality of voids;

d) a backplate comprising a vertical wall with the vertical wall comprising a plurality of voids, the backplate further comprising a left side wall, a right side wall;

e) a drip pan;

f) a first and a second support structures attached to the back plate for further attachment with the wall or the ceiling, thereby allowing the front plate to be removed without having to dismount the multiple directional blow unit cooler from the wall or the ceiling, the first and the second support structures being any one of first and second back support angles and first and second mullion mount brackets; and g) an evaporation coil arranged laterally within a lower section of the back plate with air being drawn from a bottom of the evaporation coil, thereby allowing the voids of the back plate to be covered or filled with fans without disturbing the evaporation coil; and h) a circulation void for drawing air over the evaporation coil.

11. The multiple directional blow unit cooler for horizontal placement of claim 10, wherein the front plate is attached to the back plate.

12. The multiple directional blow unit cooler for horizontal placement of claim 10, further comprising a pair of back support angles attached to the back plate.

* * * * *